United States Patent [19]

Sakakino et al.

[11] Patent Number: 4,780,584

[45] Date of Patent: Oct. 25, 1988

[54] DIGITAL SWITCH ASSEMBLY

[75] Inventors: Takahiro Sakakino, Nagaokakyo; Yasuo Ohashi, Kyoto, both of Japan

[73] Assignee: Omron Tateisi Electronics Co., Kyoto, Japan

[21] Appl. No.: 508,722

[22] Filed: Jun. 28, 1983

[30] Foreign Application Priority Data

| | | | |
|---|---|---|---|
| Jun. 30, 1982 | [JP] | Japan | 57-99650 |
| Jul. 1, 1982 | [JP] | Japan | 57-100192 |
| Jul. 2, 1982 | [JP] | Japan | 57-100947 |
| Jul. 5, 1982 | [JP] | Japan | 57-102029 |

[51] Int. Cl.[4] ..... H01H 13/04

[52] U.S. Cl. ..... 200/305; 200/11 TW; 200/156

[58] Field of Search ..... 200/156, 305, 11 TW; 174/5 SG

[56] References Cited

U.S. PATENT DOCUMENTS

| | | | |
|---|---|---|---|
| 3,772,485 | 11/1973 | Workings | 200/11 TW |
| 4,218,593 | 8/1980 | Mayer et al. | 200/11 TW |
| 4,257,283 | 3/1981 | Haller et al. | 200/156 |

FOREIGN PATENT DOCUMENTS

| | | | |
|---|---|---|---|
| 1113143 | 11/1981 | Canada | 200/305 |
| 2094553 | 9/1982 | United Kingdom | 200/305 |

*Primary Examiner*—Renee S. Luebke

*Attorney, Agent, or Firm*—Wegner & Bretschneider

[57] ABSTRACT

A digital switch assembly which comprises a casing having a plurality of output terminals, a rotor rotatably accommodated within the casing and adapted to be rotated either directly or indirectly by the application of a finger pressure thereto, feelers carried by and positioned inside the casing and electrically connected to the respective output terminals; a circuit board carried by the rotor and having a predetermined pattern of electric circuits adapted to be selectively engaged with the feelers to complete a desired circuit configuration depending on the position of the rotor, a grounding terminal member carried by the casing, and a circuit element extending substantially between the location at which the finger pressure is applied to rotate the rotor and the grounding terminal member for establishing a discharge circuit through which an electrostatic charge set up in the body of the operator can be grounded.

10 Claims, 10 Drawing Sheets

10a
10
17a
14
12
11
13
12
17
17b
17
17b
16
15
25
25a
26
24
22
23
27
25
25a
18
19a
17
19
17
18
21
20
19a
19

DIGITAL SWITCH ASSEMBLY

BACKGROUND OF THE INVENTION

1. Field of the Invention

This invention generally relates to a switch assembly and, more particularly, to a digital switch assembly suited for use as an input device for inputting numerical information such as, for example, temperature, time or count, to an electronic instrument, for example, a timer, a counter or a measuring device.

2. Description of the Prior Art

A digital input device currently widely used in, for example, a measuring instrument, comprises, as shown in FIG. 1 of the accompanying drawings, a digital switch unit 2 comprised of a plurality of switch assemblies 1 connected together in side-by-side relation to each other, which is in turn mounted on a common instrument panel 4 of, for example, a timer device 3. Each of the switch assemblies 1 forming the digital switch unit 2 has a pair of operating members 1a adapted to be manipulated by an operator one at a time to establish a particular electric circuit associated with a digital data to be inputed.

Where each of the switch assemblies SW is manufactured in a miniature size as it is a recent trend in the art, it has been found that, when one of the operating members in each switch assembly is depressed by the application of an external finger pressure, the finger of the operator is brought in the close vicinity of an internal circuit element, for example, a printed circuit board having a pattern of conductors formed thereon, which is located inside the switch assembly. By way of example, the finger tip of the operator depressing the operating member comes to a position spaced a distance of about 2 to 3 mm from the printed circuit board. Once the finger tip is brought to such a position, discharge of an electrostatic charge set up in the body of the operator takes place between the finger tip and a portion of the printed circuit board closest thereto, generating a high voltage which would adversely affect the circuit arrangement to such an extent as to result in erroneous operation of the circuit arrangement and/or damages to electronic component parts employed in the circuit arrangement.

SUMMARY OF THE INVENTION

Accordingly, this invention has been developed with a view to substantially eliminating the above described disadvantages inherent in the prior art switch assembly and has for its essential object to provide an improved switch assembly which is compact in size and substantially free from such damages as may be brought by the discharge of the electrostatic charge set up in the body of the operator.

BRIEF DESCRIPTION OF THE DRAWINGS

This and other objects and features of this invention will become readily understood from the following description taken in conjunction with preferred embodiments thereof with reference to the accompanying drawings, in which.

DESCRIPTION OF THE PREFERRED EMBODIMENTS

Figure 1:
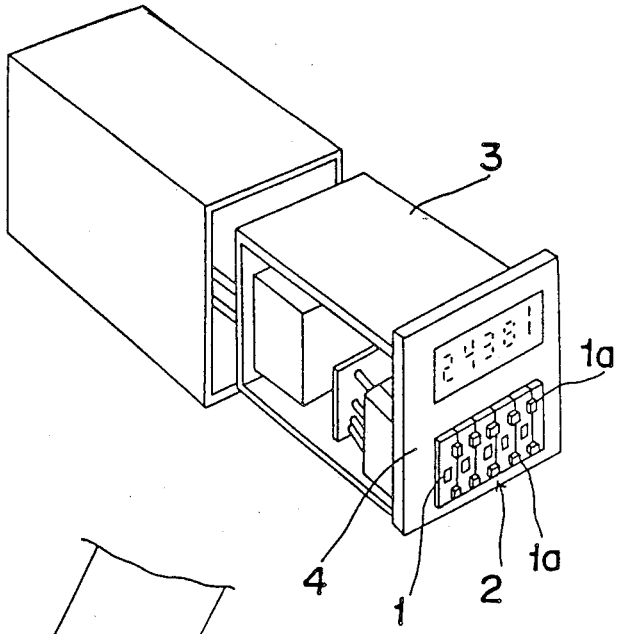
Fig. 1 PRIOR ART
FIG. 1 is a schematic perspective view showing the prior art digital switch unit comprised of the switch assemblies.

Before the description of the preferred embodiments of this invention proceeds, it is to be noted that like parts are designated by like reference numerals throughout the accompanying drawings.

Figures 2, 4:
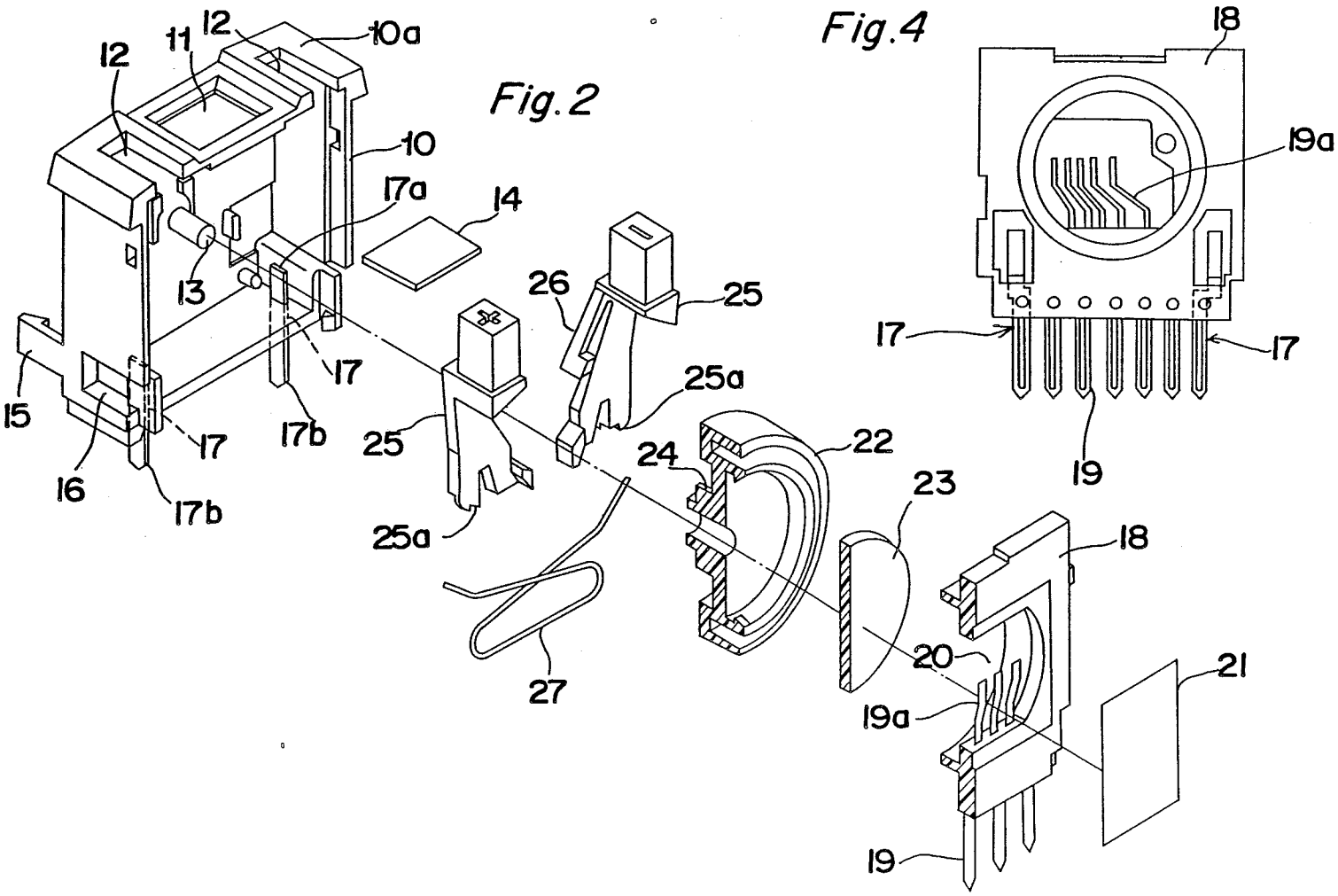
FIG. 2 is an exploded view of a digital switch assembly according to a first preferred embodiment of this invention.
FIG. 4 is a side elevational view, on a reduced scale, of the switch assembly shown in FIG. 2.

Referring first to FIGS. 1 and 2 and in accordance with a first preferred embodiment of this invention, a digital switch assembly comprises a casing constituted by a base 10 of a generally container-like configuration and a cover plate 18. The base 10 includes a top operating panel 10*a* having a window 11 and a pair of openings 12 defined therein, said openings 12 positioned on respective lateral sides of the window 11. For the purpose of anti-dust protection, the window 11 is covered by a transparent plate 14. The base 10 also includes a pair of side panels having respective engagement pawls 15 formed integrally therewith and protruding rearwardly of the base in a direction opposite to the cover plate 18 and also having respective engagement recesses 16 defined therein in alignment with the engagement pawls 15. The base 10 further includes a bottom panel carrying a pair of spaced grounding terminals 17 pressure-fitted thereto, or otherwise insert-molded thereinto, and extending downwardly outwardly therefrom for external electrical connection to the ground potential, each of said grounding terminals 27 having its opposite ends 17*a* and 17*b* situated inside and outside the base 10.

The cover plate 18 carries a plurality of output terminals 19 embedded therein during the manufacture thereof by the use of a plastics insert-molding technique and have respective feelers 19*a* formed integrally therewith. This cover plate 18 has a central opening 20 which is in turn closed by a sheet member 21.

A rotor 22 is accommodated within the casing and is rotatably mounted on a shaft 13 formed integrally with the base 10 and protruding therefrom in a direction towards the cover plate 18. The rotor 22 has its outer peripheral surface printed with, or otherwise embossed with, a series of numerical figures 0 to 9. The rotor 22 has one end face carrying a printed circuit board 23 having a predetermined pattern of conductors (not shown) and the opposite end face formed integrally with a sprocket gear 24 in alignment with th axis of rotation of said rotor 22. It is the conductors printed on the circuit board 23 to which the feelers 29*a* integral with the output terminals 19 contact slidingly, and accordingly, as the rotor 22 rotates about the shaft 13, the feelers 29*a* can complete a plurality of electric circuits one at a time.

The casing also accommodates a pair of spaced operating members 25 protruding at one end to the outside of the casing through the respective openings 12. Each of the operating members 25 is made of electroconductive plastics or, alternatively, it may have an electroconductive film applied over the entire surface thereof or only a portion thereof that extends from a contact area accessible to a finger of an operator of the switch assembly down to the opposite contact area 25*a*. In the case of the electroconductive film, it may be deposited by the use of any known metal vaporization process or a sputtering process. It is to be noted that, although the operating members 25 may be made of metal, plastics is preferred as a material for the operating members 25 because the latter can be imparted with elasticity. The operating members 25 are normally biased upwards as viewed in FIG. 3 by a wire spring 27 having its opposite ends engaged to the contact areas 25*a* of the respective operating members 25 as best shown in FIG. 3 and are adapted to be moved downwards one at a time against the wire spring 27, when an external push or finger pressure is applied thereto, to stepwisely rotate the rotor 22 by the engagement of a respective projection 26 integral therewith with the sprocket wheel 24.

In practice, the digital switch assembly of the construction described hereinabove is used in plural number to provide a switch unit. In other words, in a certain application, the switch assemblies each being of the construction described above are connected together in side-by-side relation to each other with the engagement projections 15 of one switch assembly being elastically engaged in the engagement recesses 16 of the next adjacent switch assembly. The switch unit so fabricated is in turn mounted on a console panel for, for example, a timer and, in such case, the output terminals 19 are electrically connected to an electric circuit arrangement in the timer and the grounding terminals 17 are connected to the ground potential.

Figure 3:
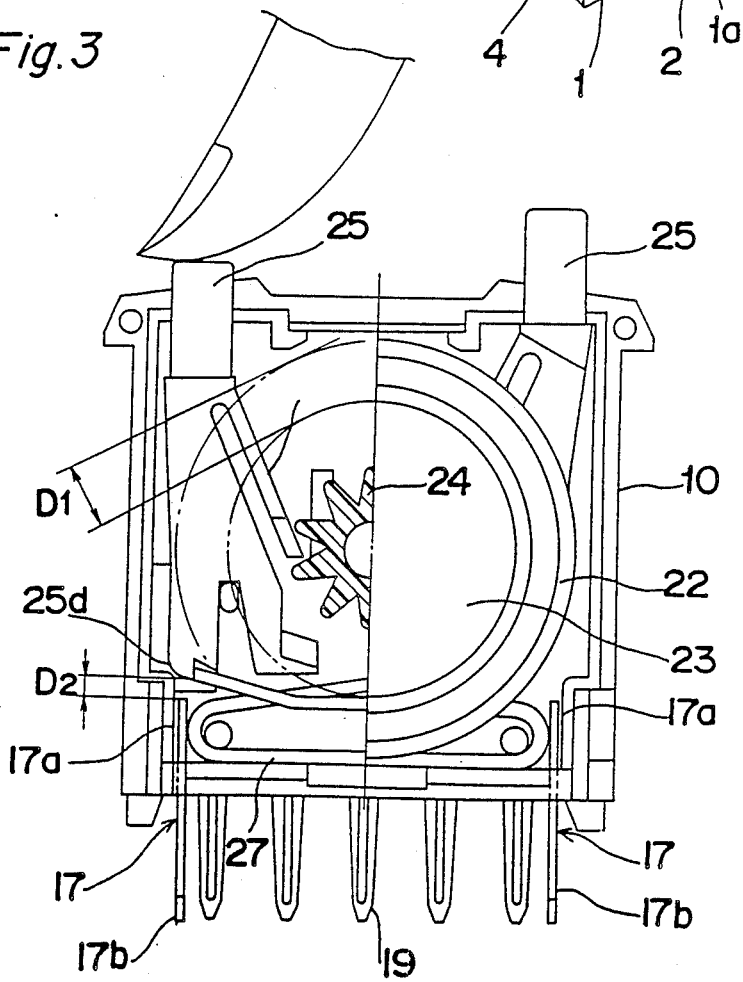
FIG. 3 is a side elevational view of the digital switch assembly shown in FIG. 2, with a portion cut away.

While the switch assembly according to this invention is constructed as hereinbefore described, and when one of the operating members 25 is depressed by the application of the external push as shown in FIG. 3, the projection 26 integral therewith pushes one tooth of the ratchet gear 24 to rotate the rotor 22 stepwisely through an angular distance corresponding to the pitch between the adjacent two teeth of the ratchet gear 24 in one direction. The rotation of the rotor 22 in the opposite direction can be similarly effected by depressing the other of the operating members 25. In either case, the switch assembly according to this invention is so designed that the minimum distance established between the operation of member 2 and the printed circuit board 23 when the operating member 25 has been depressed, which distance is indicated by D1, can become greater than the distance D2 between the corresponding contact area 25*a* of the operating member 25 being depressed and the adjacent grounding terminal 17. Accordingly, when either of the operating members 25 is depressed, an electrostatic charge set up in the body of the operator of the switch assembly can advantageously be discharged between the respective operating member 25 and the adjacent grounding terminal 17 and then to the ground then through the adjacent grounding terminal 17 and, therefore, any high voltage which would be generated upon the discharge of the electrostatic charge will not be applied to an electronic circuit arrangement in a subsequent stage, thereby minimizing or substantially avoiding any possible erroneous operation of the switch assembly and/or any possible damages to electronic component parts.

It is to be noted that, while in the construction described hereinabove, a space has been described as established between the contact area 25*a* of each of the operating members 25 and the associated grounding terminal 17 as shown by the distance D2 when the respective operating member 25 has been depressed, it may be possible to render the contact area 25*a* of the respective operating member 25 to contact the associated grounding terminal 17 when the respective operating member 25 has been depressed.

In the foregoing embodiment described with reference to and shown in FIGS. 2 and 3, since the grounding terminals 17 are carried by the bottom panel of the base 10 with their surfaces oriented at right angles to that of each of the output terminals 19. This arrangement is advantageous in that, when the switch assembly of this invention is mounted on the console panel with the terminals 17 and 19 plugged into associated sockets provided on the side of the console panel, the switch assembly of this invention can steadily be supported.

This is particularly true where only one switch assembly is utilized.

In addition, in the foregoing embodiment, the grounding terminals 17 have been described as fixed in the base 10. However, as shown in FIG. 4, they may be fixed in the cover plate 18. In this case, the grounding terminals 17 can be prepared from a single sheet of electroconductive material together with the output terminals 19 by the use of any known press work, for example, a metal blanking process, followed by the insertion of the terminals 17 and 19 in the cover plate 18 during the manufacture of the cover plate 18 by the use of any suitable plastics molding technique. According to this modification shown in FIG. 4, the number of separate component parts necessary to fabricate the switch assembly can advantageously be minimized and the switch assembly can be economically manufactured, because the formation of the terminal 17 and 19 can be done simultaneously.

Figure 5:
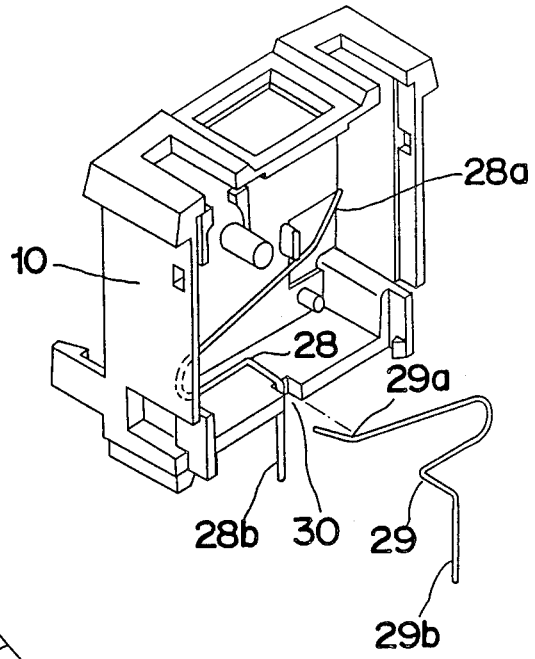
FIG. 5 is a perspective view of the switch assembly, showing a modified form of the switch assembly shown in FIG. 2.
Figure 6:
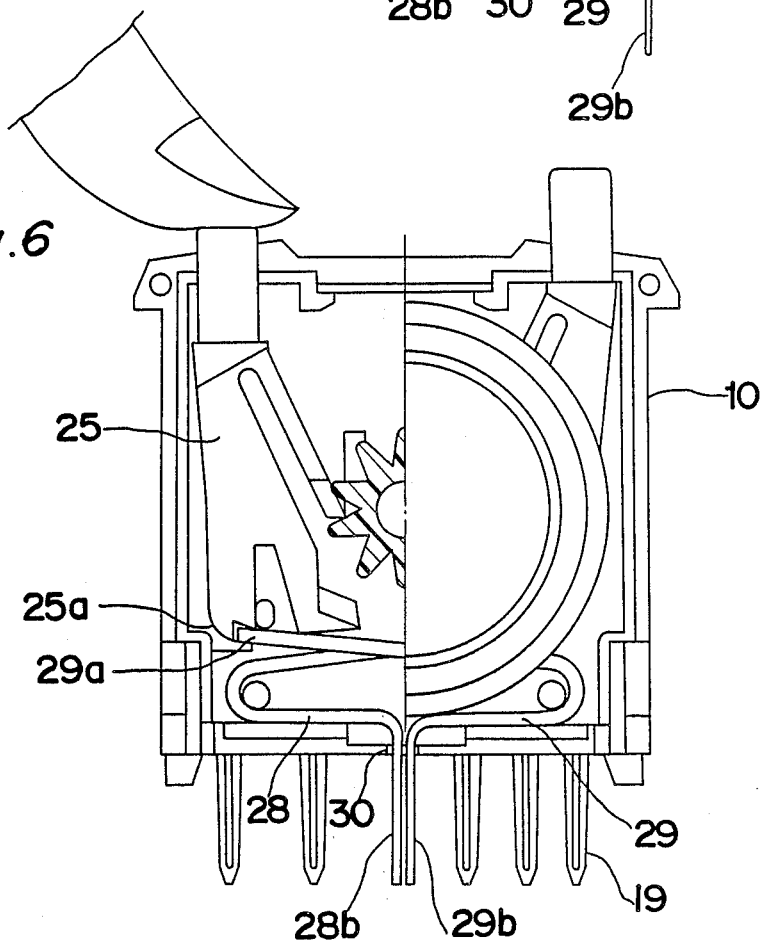
FIG. 6 is a view similar to FIG. 3, pertaining to a second preferred embodiment of this invention.

Referring now to FIGS. 5 and 6, the wire spring 27 employed in the foregoing embodiment described with reference to and shown in FIGS. 2 and 3 is replaced with separate wire springs 28 and 29 one for each operating member 25. These wire springs 28 and 29 concurrently serve as grounding terminal members and, accordingly, in the second preferred embodiment shown in FIGS. 5 and 6, these grounding terminals 17 employed in the foregoing embodiment are eliminated.

As best shown in FIG. 5, the wire spring 28 is exteriorly inserted in a bearing recess 30 defined in the bottom panel of the base 10 with its opposite ends 28*a* and 28b located inside and outside the base 10. Similarly, the wire spring 29 is exteriorly inserted in the bearing recess 30 with its opposite ends 29*a* and 29*b* located inside and outside the base 10. These wire springs 28 and 29 are so mounted that the respective ends 28*a* and 29*b* of the wire springs 28 and 29 can be held in position constantly engaged to the contact areas 25*a* of the corresponding operating members 25. Therefore, it will readily be seen that the operating members 25 are not only normally biased upwardly by the associated wire springs 28 and 29, but also grounded to the ground potential through the associated wire springs 28 and 29.

It is to be noted that the bearing recess 30 need not be always necessary. Instead of the employment of the bearing recess 30, the wire springs 28 and 29 may be held in position as inserted through the bottom panel of the base 10. This can readily be accomplished by the use of any known plastics insert-molding technique.

The digital switch assembly according to the second preferred embodiment is advantageous in that, since the wire springs 28 and 29 serve not only as biasing elements for upwardly biasing the operating members 25, but also as grounding terminals to be connected to the ground potential, the number of component parts forming the switch assembly can be minimized with the structure of the switch assembly consequently simplified.

Figure 7:
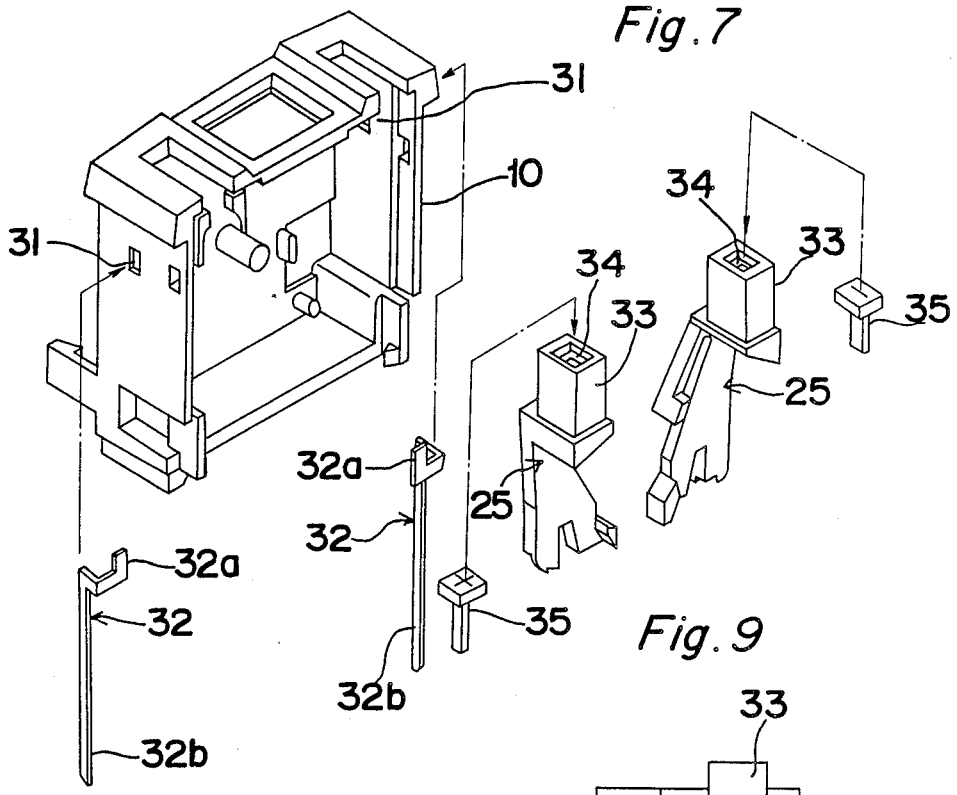
FIG. 7 is an exploded view of the switch assembly shown in FIG. 6.
Figure 9:
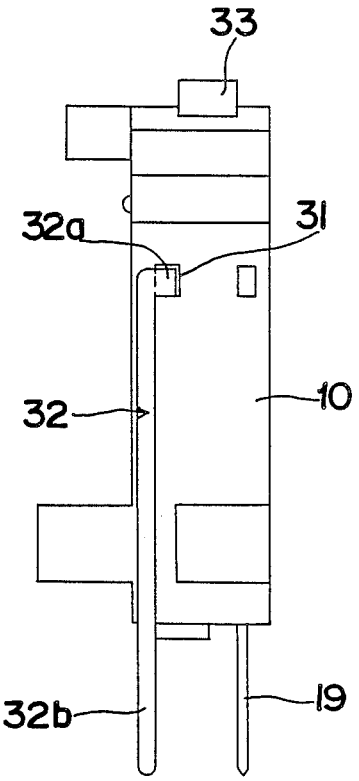
FIG. 9 is a rear end view of the switch assembly shown in FIG. 8.
Figure 8:
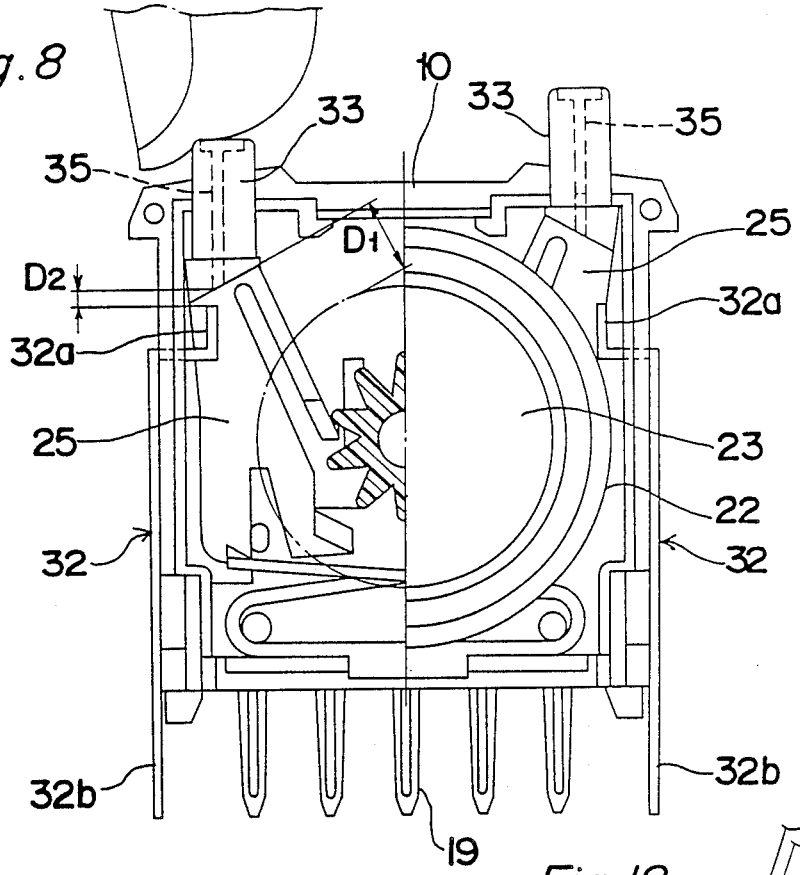
FIG. 8 is a view similar to FIG. 3, pertaining to a third preferred embodiment of this invention.

According to a third preferred embodiment shown in FIGS. 7 to 9, the side panels of the base 10 have respective through-holes 31 defined therein for receiving grounding terminals 32. The grounding terminals 32 have one end 32a extending into the base 10 through the through-holes 31 and the opposite end extending along the associated side panels and terminating exteriorly of the base 10 so as to extend in parallel relation to the output terminals 19 carried by the cover plate 18 (See FIG. 2).

One end portion of each of the operating members 25 made of non-electroconductive material, which is accessible to the finger of the operator, has a bearing hole 34 defined therein and accommodating therein a respective electroconductive Tee-piece 35 pressure-fitted thereinto. The Tee-pieces 35 in the respective bearing holes 34 defined in the associated operating members 25 have their exterior surfaces provided with any suitable indicia representative of the direction of rotation of the rotor 22 inside the casing, for example + (plus) sign and − (minus) sign as shown.

In this third embodiment of this invention shown in FIGS. 7 to 8, care if required so as to position the ends 32*a* of the grounding terminals 32 at a location spaced a minimum distance D2 from the tip of the respective electroconductive Tee-piece 35, which distance D2 should be smaller than the minimum distance D1 between the printed circuit board 23 and the end of the Tee-piece 35 in the respective operating member 25 as shown. With this design, it is possible to let the electrostatic charge built up in the body of the operator be discharged to the ground potential through any one of the Tee-pieces 35 and then through the grounding terminals 32 and, therefore, similar advantages as hereinbefore described in connection with the first preferred embodiment can equally be appreciated.

In describing any one of the foregoing embodiments of this invention, the cover plate 18 and the rotor 22 have been described as carrying the feelers 19*a* and the printed circuit board 23, respectively. However, the feelers 19*a* and the printed circuit board 23 may be provided on the rotor 22 and the cover plate 18 if desired.

In any one of the first and third embodiments of this invention, the grounding terminals 17 have been described as provided in the bottom panel of the base 10. However, according to a fourth preferred embodiment of this invention shown in FIGS. 10 to 12, only one grounding terminal 40 is employed and is provided in the cover plate 18. In this embodiment, the terminals 40 and 19 are prepared from a single sheet of electroconductive material by the use of any known press work, for example, a metal blanking process, the terminals 40 and 19 being then insert-molded into the cover plate 18 during the manufacture of the cover plate 18 by the use of any known plastics molding technique. This arrangement is advantageous in that the digital switch assembly can be manufactured with a minimized number of component parts. In addition, since the terminal 40 can be fabricated together with the terminals 19 at one process step, the digital switch assembly as a whole can also be manufactured at reduced cost.

Figure 10:
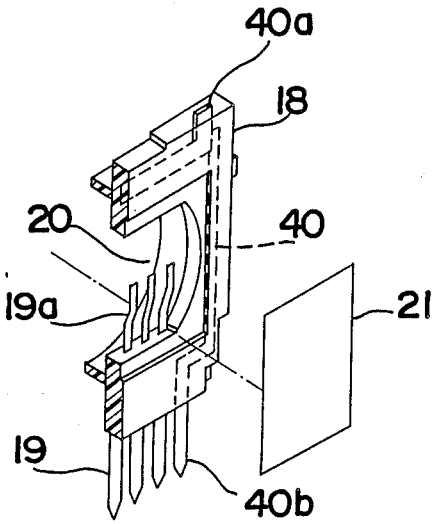
FIG. 10 is a fragmental perspective view showing a portion of a cover plate used in the switch assembly according to a fourth preferred embodiment of this invention.
Figure 11:
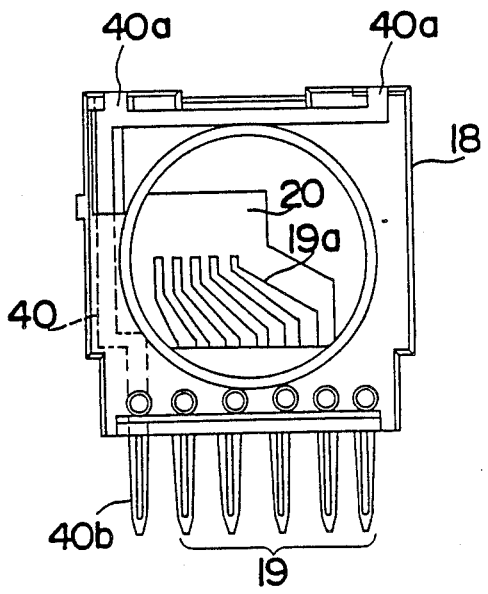
FIG. 11 is a side elevational view of the cover plate shown in FIG. 10.
Figure 12:
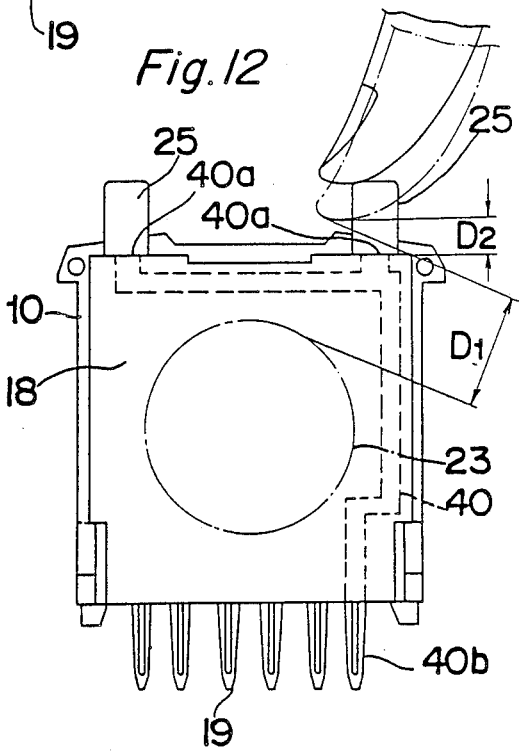
FIG. 12 is a side elevational view of the switch assembly employing the cover plate shown in FIG. 10.

In addition, in the fourth embodiment shown in FIGS. 10 to 12, one end portion of the grounding terminal 40 inside the base 10 extends, as best shown in FIG. 10, upwards along one side panel of the base 10 and then bent so as to extend beneath the top panel towards the opposite side panel. Spaced areas of the end portion of the grounding terminal, shown generally by 40*a*, are exposed to the outside of the base 10 through the respective openings 12 defined in the top panel of the base 10. The other end portion of the grounding terminal 40 opposite to that one end portion thereof is situated outside the base 10 for external electric connection with the ground potential.

The digital switch assembly according to the fourth embodiment of this invention operates in the following manner. Assuming that one of the operating members 25 is depressed by the application of the external finger pressure thereto, the rotor 22 is stepwisely rotated in the manner as hereinbefore described in connection with the first embodiment of this invention. At this time, that is, when and so long as the operating member 25 is depressed, the minimum distance D1 between the tip of the finger of the operator touching the operating member 25 and the adjacent area 40*a* of the grounding terminal 40 becomes smaller than the minimum distance D2 between the tip of the finger of the operator and the printed circuit board 23 carried by the rotor 22 and, accordingly, the electrostatic charge built up in the body of the operator is discharged between the area 40*a* of the grounding terminal 40 and the tip of the finger of the operator and is then grounded to the ground through the grounding terminal 40.

In view of the foregoing, similar advantages as hereinbefore described in connection with the foregoing embodiments can equally be appreciated with the switch assembly according to the fourth embodiment of this invention.

In the fourth embodiment shown in FIGS. 10 to 12, the grounding terminal has been described as embedded in the cover plate 18. However, a grounding terminal corresponding functionally to the grounding terminal 40 shown in FIGS. 10 to 12 may be constituted by an electroconductive film or layer which will now be described in connection with a fifth preferred embodiment of this invention with reference to FIGS. 13 and 14.

Figure 13:
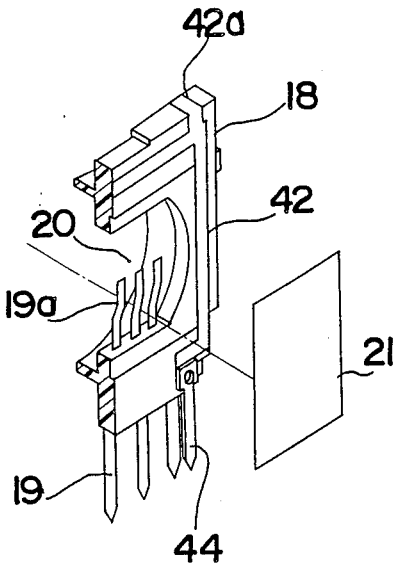
FIG. 13 is a fragmental perspective view showing a portion of a cover plate used in the switch assembly according to a fifth preferred embodiment of this invention.
Figure 14:
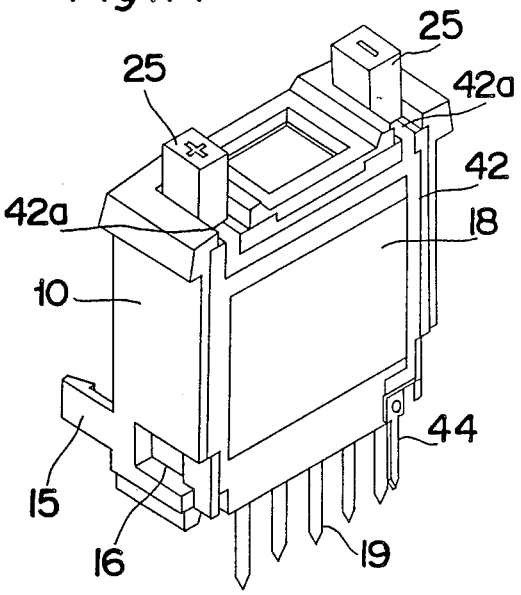
FIG. 14 is a perspective view of the switch assembly employing the cover plate shown in FIG. 13.

Referring now to FIGS. 13 and 14, the cover plate 18 has a grounding terminal piece 44 secured to a lower portion of the exterior surface thereof so as to extend downwards in parallel relation to the output terminals 19. An electroconductive strip 42 is formed on the exterior surface of the cover plate 18 by the use of any known metal vapor deposition technique or a printing technique so as to extend upwards from the terminal piece 44 along one side portion of the cover plate 18 and then laterally along an upper portion of the cover plate 18 with portions 42*a* thereof situated in the openings 12 in the base 10. It is to be noted that the terminal piece 44 is preferably secured to the cover plate 18 in the manner described above after the conductive strip 42 has been formed.

The digital switch assembly according to the fifth embodiment shown in and described with reference to FIGS. 13 and 24 functions in a manner substantially similar to that of the switch assembly according to the fourth embodiment shown in FIGS. 10 to 12.

Figure 15:
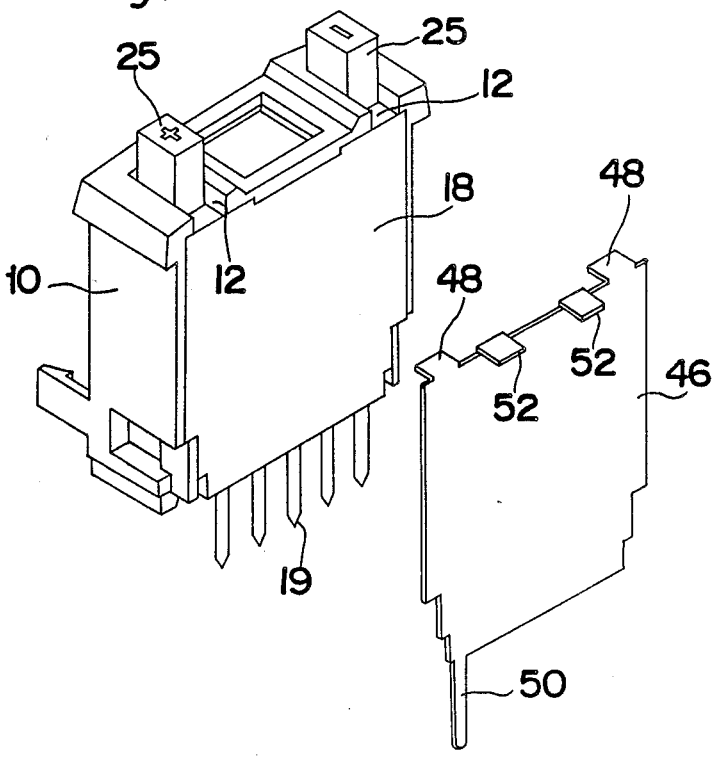
FIG. 15 is an exploded view showing the switch assembly according to a sixth preferred embodiment of this invention.

In a sixth preferred embodiment shown in FIG. 15, as a terminal member defining the path through which the electrostatic charge built up in the body of the operator of the switch assembly can be discharged to the ground, a metal plate 46 is employed. As best shown in FIG. 15, the metal plate 46 has a projection or terminal piece 50, a first pair of tongues 48 and a second pair of tongues 52, all formed integrally therewith. The terminal piece 50 is adapted to be connected to the ground potential. The first pair of the tongues 48 and the second pair of the tongues 52 protrude at right angles to the body of the metal plate 46 in a direction opposite to each other, the first pair of the tongues 48 being positioned in the openings 12 in the top panel of the base 10 of one digital switch assembly and the second pair of the tongues 52 positioned in the openings 12 in the top panel of the base 10 of the next adjacent digital switch assembly (not shown) when the metal plate 46 is held is position between the two adjacent switch assemblies which are coupled together in side-by-side relation to each other.

As is the case with the foregoing embodiment, when one of the operating members 25 is depressed by the application of the finger pressure, the tip of the finger of the operator touching the one of the operating members 25 approaches the corresponding tongue 48 and, accordingly, the electrostatic charge built up in the body of the operator can be discharged to the ground in a manner substantially similar to that in any one of the foregoing embodiments.

The use of the metal plate 46 according to the embodiment shown in FIG. 15 is advantageous in that it can be employed in association with any type of existing switch assemblies and may not be limited to the particular type of switch assembly described hereinbefore.

The seventh and eighth embodiments of this invention shown respectively in FIGS. 16 to 19 and FIGS. 20 to 23 are applicable to the switch unit UN comprised of a plurality of digital switch assemblies SW each being of the construction described hereinbefore.

Referring now to FIGS. 16 to 19, the operating panel 10*a* of the base 10 of each of the switch assemblies SW has through-holes 54 defined therein and extending in a direction generally parallel to the shaft 13. The through-holes 54 in each base 10 of the switch assemblies SW is in turn communicated to the outside through respective apertures 56 also defined in the operating panel 10*a* so as to extend at right angles to the longitudinal axis of the through-holes 54.

Figure 16:
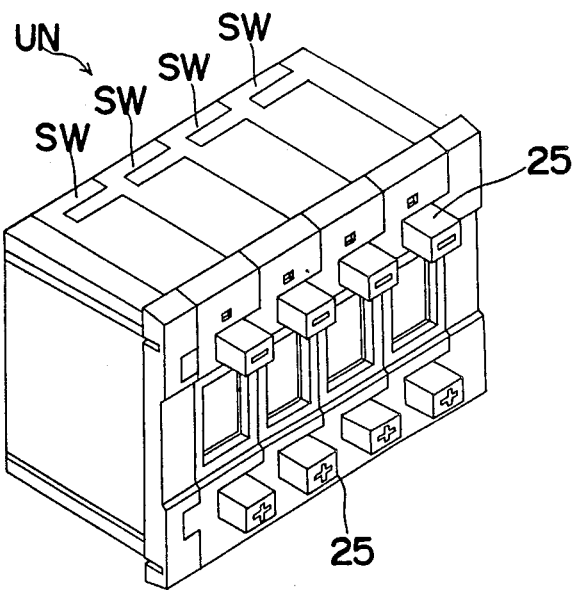
FIG. 16 is a perspective view showing a digital switch unit comprised of a plurality of digital switch assemblies fabricated together according to a seventh preferred embodiment of this invention.
Figure 18:
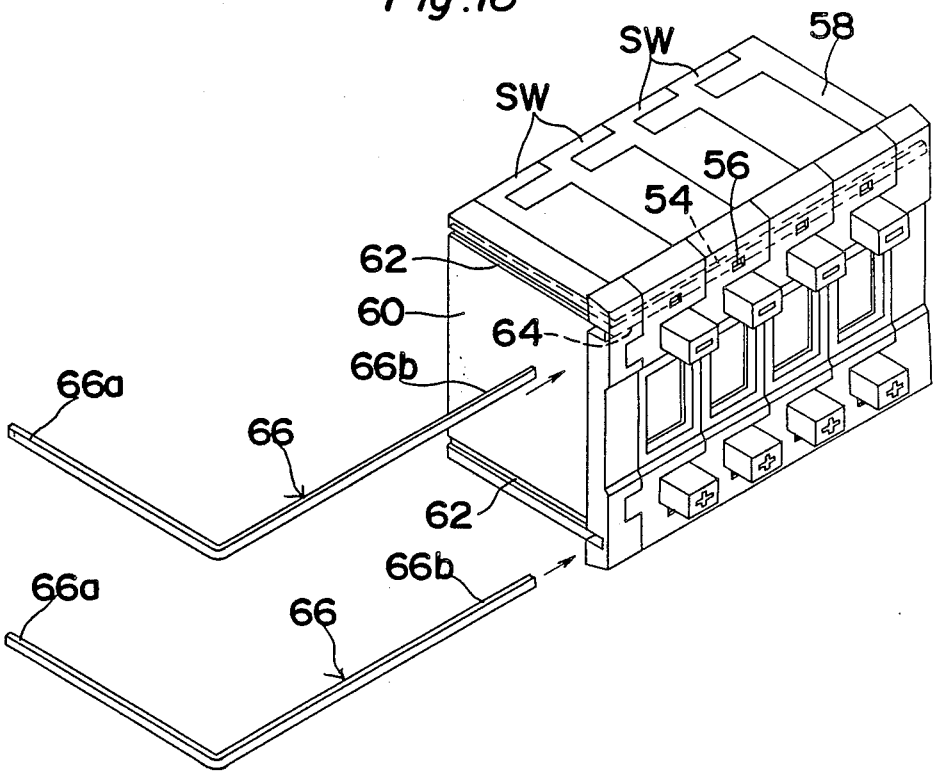
FIG. 18 is a perspective view showing a method of insertion of electroconductive rods in the switch unit of FIG. 10.
Figure 17:
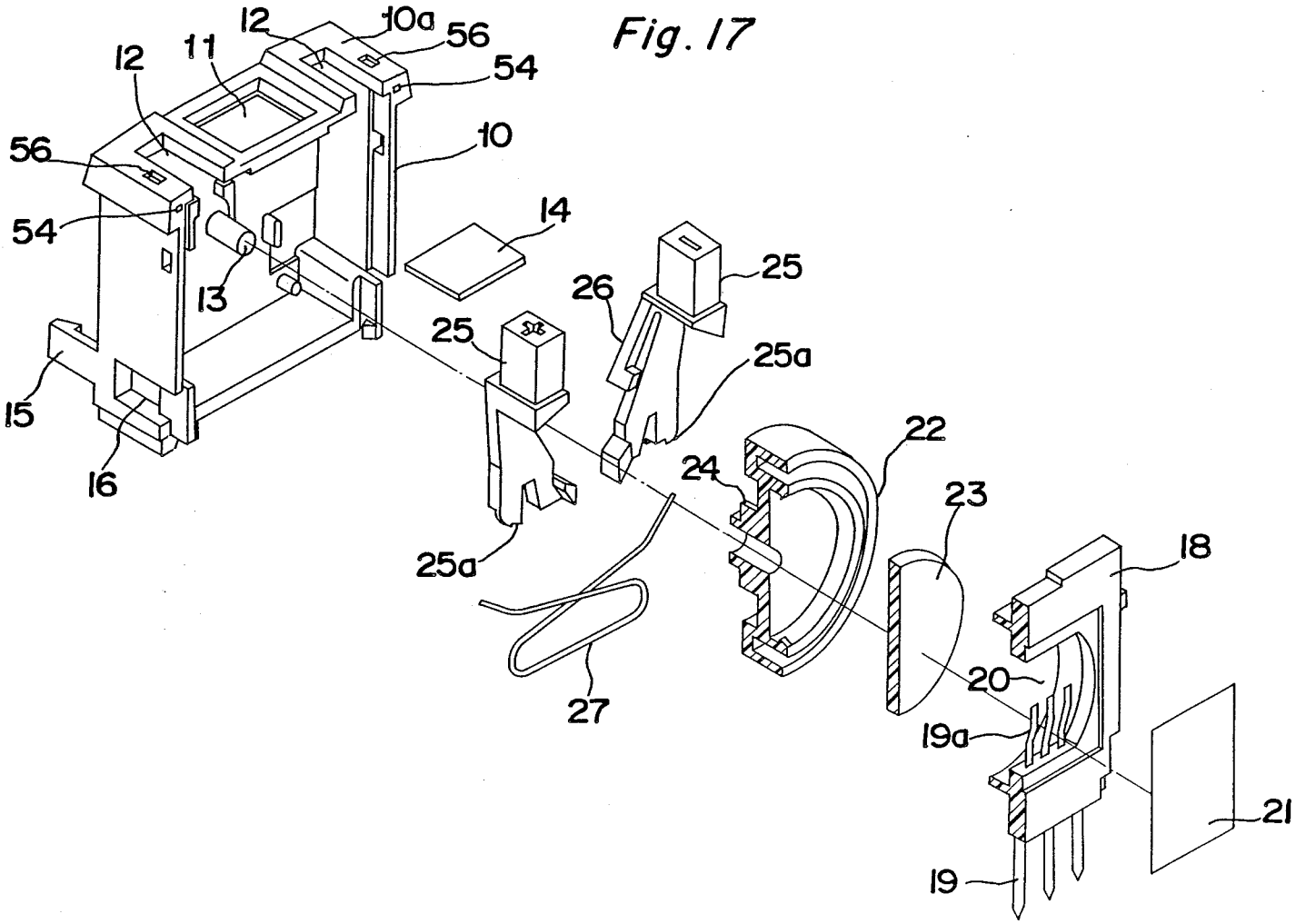
FIG. 17 is an exploded view of one of the switch assemblies forming the switch unit of FIG. 16.

As best shown in FIGS. 16 and 18, the switch unit UN is fabricated by connecting the switch assemblies SW in side-by-side relation to each other with the engagement pawls 15 of one switch assembly SW snapped into the corresponding engagement recesses 16 of the next adjacent switch assembly SW and then connecting a pair of end plates 58 and 50 to the respective lateral sides of the assembly of the switch assemblies SW. When the switch assemblies SW are so fabricated into the switch unit UN as shown in FIG. 16, the through-holes 54 best shown in FIG. 17 in all of the bases 10 of the respective switch assemblies SW are axially aligned with each other, defining respective passages shown by 64 in FIG. 18.

The end plate 62 has a pair of grooves 62 defined therein in spaced relation to each other and so as to extend in a direction at right angles to the associated passages 64, said grooves 62 and said passages 64 representing a generally L-shaped configuration. Reference numeral 66 represent generally L-shaped electroconductive rods having the respective opposite end portions 66*a* and 66*b* at right angles to each other. Each of the electroconductive rods 66 serves not only to connect the switch assemblies SW together so as to avoid any possible accidental separation, but also to define a circuit through which the electrostatic charge built up in the body of the operator operating any one of the operating members 25 of the respective switch assemblies SW can be discharged to the ground. For this purpose, the end portion 66*a* of each of the electroconductive rods 66 is inserted through the respective passage 64 while the end portion 66*b* thereof is received in the respective groove 62, it being, however, to be noted that the extremity of the end portion 66*b* opposite to the end portion 66*a* is, after having been inserted through the passage 64, bent to firmly connect the switch assemblies SW together while the extremity of the end portion 66*a* opposite to the end portion 66*b* is allowed to extend a distance outwardly from the resultant switch unit UN for the purpose of electrical connection to the ground.

Figure 19:
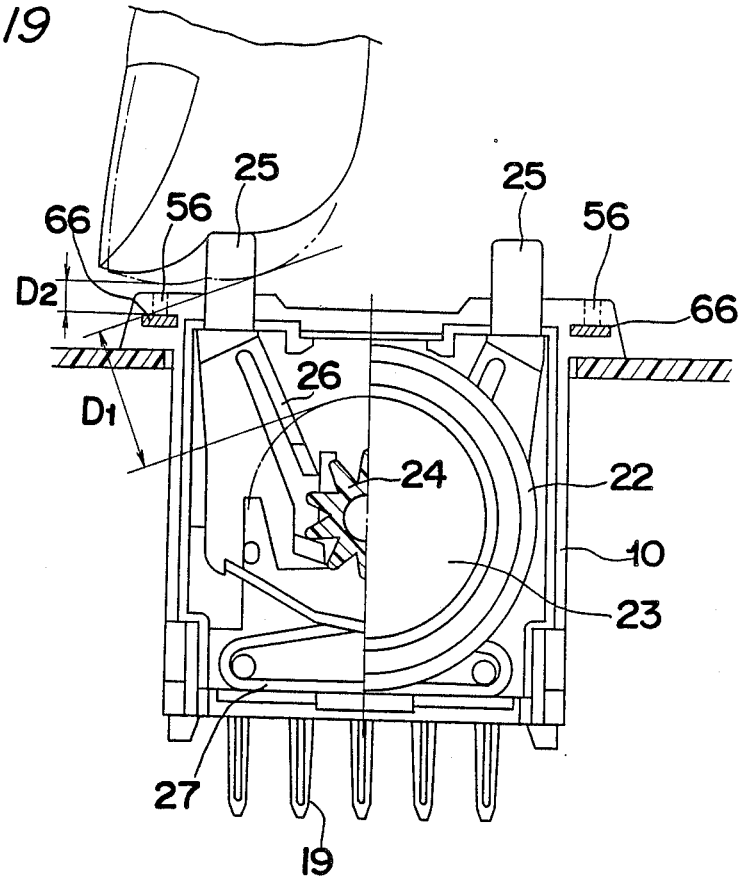
FIG. 19 is a side elevational view, with a portion cut away, of one of the switch assemblies forming the switch unit of FIG. 10.

In the embodiment described with reference to and shown in FIGS. 16 to 19, it will readily be seen that the circuit for the discharge of the electrostatic charge built up in the body of the operator can be established from the tip of the finger via the aperture 56 adjacent the finger and then through the electroconductive rod 66 also adjacent the finger. As best shown in FIG. 19, when one of the operating members 25 of any of the switch assemblies SW is depressed, the distance D2 between the tip of the finger of the operator and a corresponding portion of the electroconductive rod 66 through the respective aperture 56 becomes smaller than the distance D1 between the tip of the finger and the printed circuit board 23 and, therefore, the electrostatic charge in the body of the operator can advantageously be discharged to the ground in a manner substantially similar to that in any one of the foregoing embodiments.

Figure 20:
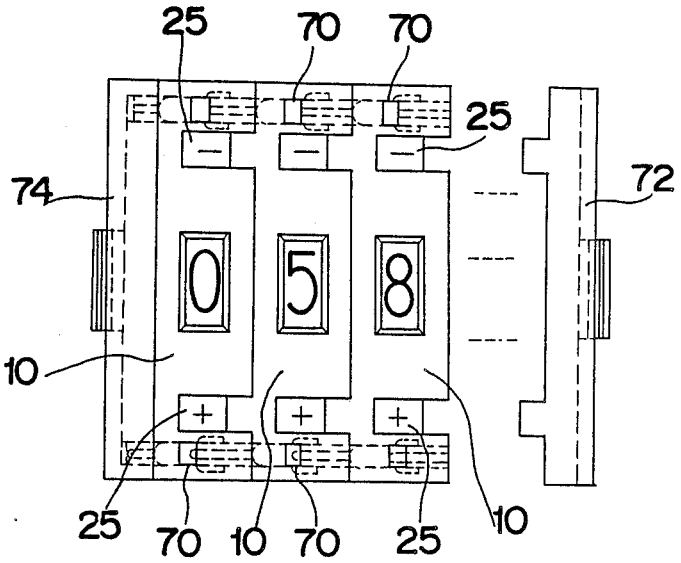
FIG. 20 is a front elevational view of the digital switch unit comprised of the switch assemblies according to an eighth preferred embodiment of this invention.
Figure 21:
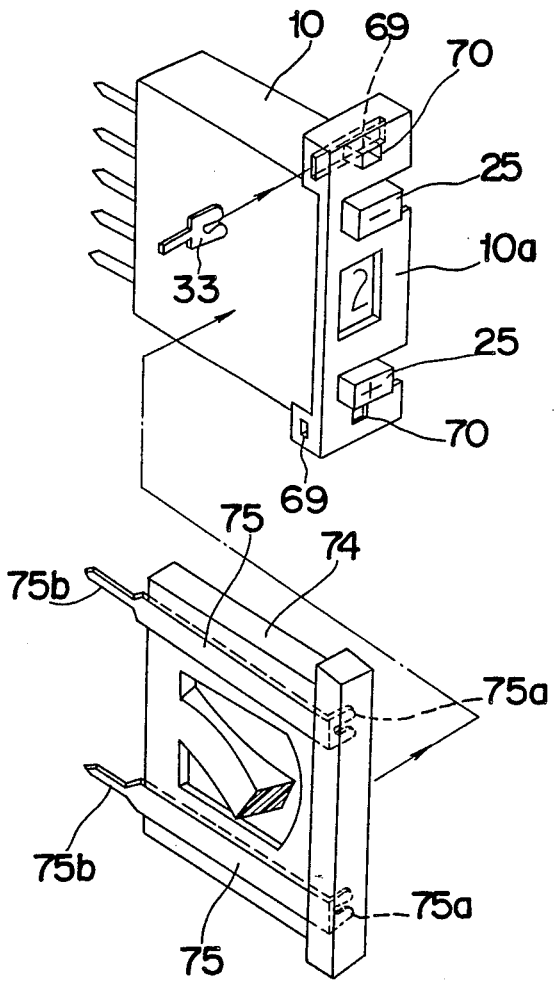
FIG. 21 is an exploded view of one of the switch assemblies of the switch unit of FIG. 20, showing one of the end plates used therein.

In the eighth embodiment of this invention shown in FIGS. 20 to 23, a pair of generally straight electroconductive rods 75 are, instead of the generally L-shaped rods 66 described and shown as employed in the foregoing embodiment as shown in FIG. 18, employed in the form as embedded in, or otherwise exteriorly carried by, one of the opposite end plates, for example, the end plate 74. As best shown in FIG. 21, each of the electroconductive rods 75 has one end 75*a* bent to protrude at right angles to the remaining portion thereof and forked to provide a pair of spaced fingers cooperable with a respective coupling element 71 as will be described later. While a substantially intermediate portion of each of the electroconductive rods 75 is embedded in, or otherwise exteriorly carried by, the end plate 74, the other end 75*b* thereof protrudes rearwardly as viewed in FIG. 21 to provide a respective grounding terminal.

Figure 23:
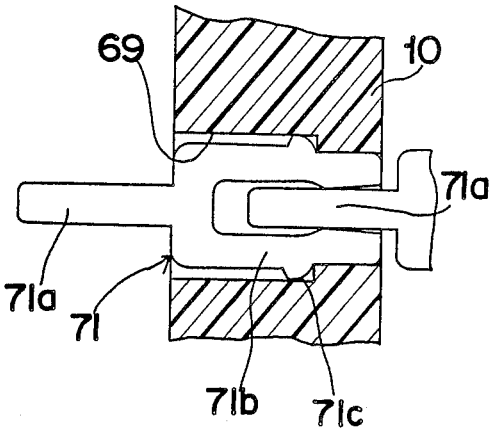
FIG. 23 is a cross sectional view, on an enlarged scale, of a wall of one of the switch assemblies of the switch unit of FIG. 20, showing the manner in which one coupling element is connected with the next adjacent coupling element.

As best shown in FIGS. 21 and 23, the operating panel 10*a* of the base 10 has a pair of spaced stepped through-holes 69 defined therein for the accommodation of the respective coupling elements 71 therein, which stepped through-holes 69 are in turn communicated to the outside of the base 10 through respective apertures 70 opening in the operating panel 10*a* adjacent the associated operating members 25.

Figure 22:
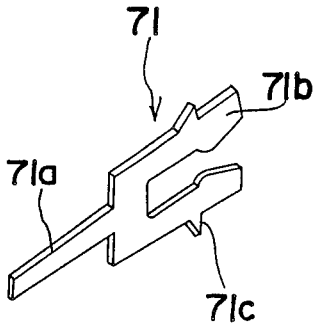
FIG. 22 is a perspective view of one of coupling elements used in the switch unit of FIG. 20.

As best shown in FIGS. 22 and 23, each of the coupling elements 71 is of a generally Y-shaped configuration having a stem portion 71*a* having one end from which a pair of fingers 71*b* and 71*c* protrude outwards generally in parallel relation to each other. Each of the coupling elements 71 of the configuration described above is pressure-fitted into the respective stepped through-hole 69 with the fingers 71*b* and 71*c* situated inside such respective through-hole 69 and with the stem portion 71*a* protruding laterally outwardly from the operating panel 10*a* of the base 10.

From the foregoing, it will readily be seen that, when a number of the switch assemblies SW are connected together in side-by-side relation to each other substantially as shown in FIG. 20, the stem portions 71*a* of the coupling elements 71 in one switch assembly are plugged respectively in between the fingers 71*b* and 71*c* of the coupling elements 71 in the next adjacent switch assembly. The complete switch unit UN can be fabricated by connecting the switch assemblies SW in the manner described above while the assembly of the switch assemblies SW are sandwiched between the end plates 72 and 74 as shown in FIG. 20. It is to be noted that, when the end plate 74 is fitted laterally to one of the connected switch assemblies SW which is located adjacent thereto, the stem portions 71*a* of the coupling elements 71 in such one of the connected switch assemblies SW are received in between the forked fingers of the ends 75*a* of the associated electroconductive rods 75. It is also to be noted that each stem portion 71*a* of one coupling element 71 is plugged in between the respective fingers 71*b* and 71*c* of the next adjacent coupling element 71, such stem portion can be firmly sandwiched therebetween under the influence of the resiliency of the fingers 71*b* and 71*c* and, therefore, an electric circuit between one coupling element 71 and the next adjacent coupling element 71 can be firmly established. This is also true of the connection between the stem portions 71*a* and the fingers in the associated electroconductive rods 75 in the end plate 74.

From the foregoing, it is clear that the switch unit UN comprised of the switch assemblies SW connected together in side-by-side relation to each other operates in a manner similar to the switch unit according to the foregoing embodiment. In any event, so far as the individual switch assemblies SW are concerned, each switch assembly SW operates in the manner as hereinbefore described in connection with the numerous foregoing embodiments.

The switch unit UN according to the eighth embodiment of this invention is advantageous as compared with that according to the foregoing, seventh embodiment in that, while in the seventh embodiment the number of the switch assemblies to be connected together to provide the switch unit is limited for a given size or length of each electroconductive rod 66, a desired number of the switch assemblies SW can be connected together and, therefore, electroconductive rods of different size or length need not be prepared beforehand.

While the various preferred embodiments of this invention have been fully described, it is to be noted that the switch assembly according to the first and third preferred embodiments of this invention is particularly advantageous in that, because of the presence of a space in the circuit through which the electrostatic charge set up in the body of the operator can be discharged to the ground, the possibility that the operator may be shocked by the spark discharge of the electrostatic charge can be eliminated.

Although this invention has fully been described in connection with the various preferred embodiments thereof with reference to the accompanying drawings, it is to be noted that various changes and modifications are apparent to those skilled in the art. By way of example, while reference has been made to the switch assembly of a type wherein the rotor is rotated by manipulating the operating members one at a time, this invention is equally applicable to a switch assembly wherein the rotor itself can be manually rotated. In other words, the concept of this invention can equally apply to a switch assembly of a construction wherein the rotor has a radially outwardly extending flange partly exposed to the outside through the operating panel of the switch casing for the access to the finger of the operator.

Accordingly, such changes and modifications are, unless they depart from the true scope of this invention as defined by the appended claims, to be construed as included therein.

What is claimed is:

1. A digital switch assembly which comprises, in combination, a casing having a plurality of output terminals;

a rotor rotatably accommodated within the casing;

means accessible to an operator for rotating the rotor within the casing;

feelers carried by and positioned inside the casing and electrically connected to the respective output terminals;

a circuit board carried by the rotor and having a predetermined pattern of electric circuits adapted to be selectively engaged with the feelers to complete a desired circuit configuration depending on the position of the rotor;

a grounding terminal member carried by the casing; and an electrostatic discharge path length between a finger of an operator of such switch assembly and said grounding terminal which is less than the path length between said finger and said electronic circuits.

2. A switch assembly as claimed in claim 1, wherein said rotating means comprises at least one operating member adapted to be pushed from an inoperative position towards an operated position, said operating member having a projection engageable with the rotor for rotating the rotor stepwisely as said operating member is moved from the inoperative position towards the operated position by the application of a finger pressure, and a biasing means for biasing the operating member so as to assume the inoperative position in the absence of the application of the finger pressure to the operating member.

3. A switch assembly as claimed in claim 2, wherein said biasing means comprises a metallic spring and wherein said electrostatic discharge path comprises an electroconductive member which is constituted by said metallic spring.

4. A switch assembly as claimed in claim 2, wherein said operating member includes a finger discharge path circuit element which circuit element comprises an electroconductive layer formed on said operating member.

5. A switch assembly as claimed in claim 4, wherein the circuit element comprises a metallic plate having at least one portion located adjacent the rotating means, and wherein said grounding terminal member is formed integrally with said metallic plate.

6. A switch assembly as claimed in claim 4, wherein the circuit element comprises a layer of electroconductive material formed on one surface of the casing so as to extend from a location adjacent the rotating means to the grounding terminal member.

7. A switch assembly as claimed in claim 4, wherein the circuit element is constituted by at least one metallic connecting rod adapted to connect a plurality of switch assemblies together in side-by-side relation to each other.

8. A switch assembly as claimed in claim 4 further including an electroconductive member having one end connected to the grounding terminal member.

9. A switch assembly as claimed in claim 8, wherein said electroconductive member is constituted by one of the opposite ends of the grounding terminal member which is situated inside the casing.

10. A switch assembly as claimed in claim 8 wherein said finger discharge path circuit element is moved into contact with said electroconductive member having one end connected to the grounding terminal.

* * * * *